US006715217B1

(12) United States Patent
Wright et al.

(10) Patent No.: US 6,715,217 B1
(45) Date of Patent: Apr. 6, 2004

(54) MICROFILM JACKET DRYING DEVICE AND METHOD

(75) Inventors: David E. Wright, Bassett, VA (US); Dwayne D. Wright, Bassett, VA (US)

(73) Assignee: Eastern Microfilm Sales and Service, Inc., Stuart, VA (US)

( * ) Notice: Subject to any disclaimer, the term of this patent is extended or adjusted under 35 U.S.C. 154(b) by 0 days.

(21) Appl. No.: 10/283,952

(22) Filed: Oct. 30, 2002

(51) Int. Cl.[7] ..... F26B 3/04; F26B 25/06

(52) U.S. Cl. ..... 34/451; 206/313; 206/456; 34/448; 34/105; 34/619; 34/210; 34/232

(58) Field of Search ..... 34/419, 448, 451, 34/104, 105, 619, 627, 629, 210, 230, 232; 206/312, 313, 455, 456

(56) References Cited

U.S. PATENT DOCUMENTS

| | | | | |
|---|---|---|---|---|
| 3,964,828 A | | 6/1976 | Yamada et al. | |
| 4,014,048 A | | 3/1977 | Rappleyea | |
| 4,105,319 A | | 8/1978 | Wells et al. | |
| 4,388,881 A | | 6/1983 | Price | |
| 4,866,864 A | | 9/1989 | Kiejzik | |
| 5,637,325 A | | 6/1997 | Greene et al. | |
| 5,788,075 A | * | 8/1998 | Wrabel | 206/455 |

* cited by examiner

*Primary Examiner*—Pamela A Wilson

(57) ABSTRACT

A microfilm drying device and method are presented for salvaging and drying microfilm which has become wet due to excessive moisture resulting from high water, floods and the like. The device includes a needle assembly which is slidably affixed within a frame to direct air into the internal compartments of a flexible jacket containing microfilm strips. In another embodiment, a hand held drying device allows air to pass through a series of needles to dry the interior of the flexible jackets.

20 Claims, 6 Drawing Sheets

MICROFILM JACKET DRYING DEVICE AND METHOD

FIELD OF THE INVENTION

The invention pertains to drying of microfilm contained within a flexible compartmentalized jacket and particularly pertains to a drying device using hollow needles for directing fluid into the jacket compartments for drying purposes.

DESCRIPTION OF THE PRIOR ART AND OBJECTIVES OF THE INVENTION

Microfilm strips having images thereon are conventionally stored in transparent, flexible, polymeric envelopes or jackets having one or more compartments for protection purposes. The ends of the jacket compartments are not sealed to allow entry and exit of the microfilm strips as needed. The jacket thus provides protection from dust and debris and safe storage under most circumstances while the transparency of the walls allows the microfilm strips to be readily seen. In recent years unusual weather conditions in certain parts of the country have caused high waters and floods causing loss and damage to thousands of microfilm strips. It is not unusual for a hospital, business or government agency to store microfilm in a basement or lower floor, thus subjecting the microfilm to potential flood conditions.

When such floods occur salvage personnel attempt to rescue and reclaim as many of the microfilm strips as possible, most of which remain within the flexible storage jackets. Water will act to both damage the microfilm and cause the microfilm to adhere and react to the inner wall surfaces of the storage jacket causing irreparable damage to the microfilm strips. Many millions of dollars in valuable microfilm can be lost, requiring the microfilm images to be recreated, which is often not possible.

It is usual for salvage workers to manually remove the microfilm strips from the jackets, wipe or air dry the film and when dried, place it in new protective jackets. Such hand labor is tedious, time consuming and expensive. Oftentimes the wet microfilm is damaged as it is removed from the jacket due to the softened condition of the microfilm and the inexperience or lack of agility of the salvage personnel.

Therefore, based on the current methods of salvaging and drying microfilm and jackets which have been subjected to water such as from floods, and other wet conditions, the invention was conceived and one of the objectives is to provide a drying device and method for drying microfilm strips without having to remove the strips from the jacket compartments.

It is still another objective of the invention to provide a device to dry multiple microfilm jacket compartments simultaneously.

It is yet another objective of the invention to provide a device to allow the outer surfaces of the jacket to be dried simultaneously with the inside compartments.

It is also another objective of the invention to provide a method to quickly dry the internal compartments of a microfilm jacket without damaging the film contained therein.

Various other objectives and advantages of the present invention will become apparent to those skilled in the art as a more detailed description is set forth below.

SUMMARY OF THE INVENTION

The invention therein pertains to devices and methods for salvaging and drying microfilm strips which have been wetted due to high water, floods, sprinkler malfunctions and the like.

One form of the drying device herein includes a frame having a movable needle assembly. A standard jacket with multiple microfilm strip compartments is placed in the frame on the floor at one end. By manually sliding the needle assembly, the needles contact the open end of the jacket and penetrate the compartments. In the preferred embodiment a foot operated valve allows a suitable fluid such as air to pass through the needles into the compartments, thereby forcing any moisture therefrom. The microfilm contained within the compartments is not damaged by the needle or fluid penetration and is quickly dried by the fluid injection. The floor of the device has a series of apertures through which a heated fluid such as air is blown. In addition, an external conduit forces warm fluid such as air against the upper, outer surfaces of the jacket for drying purposes. Thus, in a matter of seconds a microfilm jacket can be completely dried both inside and outside and once again be ready for use to store microfilm strips.

In an alternative embodiment of the invention, a hand held drying device and method is disclosed which can be used to dry the inside of microfilm jackets when circumstances demand such as the need to dry a relatively small number of jackets in a quick and efficient manner.

DETAILED DESCRIPTION OF THE PREFERRED EMBODIMENT AND OPERATION OF THE INVENTION

Figure 1:
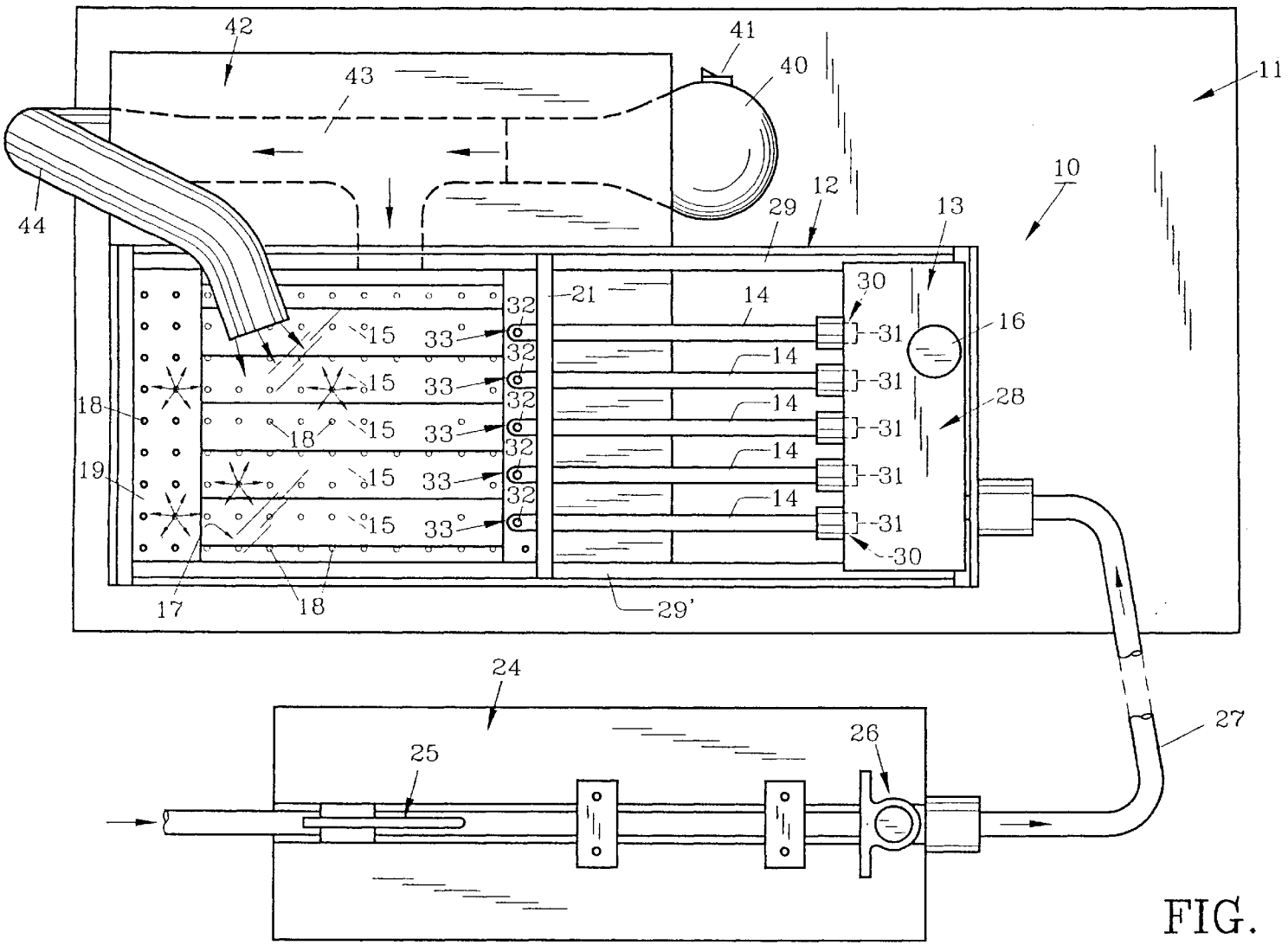
FIG. 1 demonstrates the preferred form of the invention as positioned on a table and having a foot control on the floor below, with the needles in an open or dormant position.

For a better understanding of the invention and its operation, turning now to the drawings, a top plan view of the preferred embodiment of the invention is shown in FIG. 1 demonstrating drying device 10 positioned on table 11 at a convenient work height. Drying device 10 includes frame 12 preferably formed of stainless steel, although aluminum, baked painted metal or plastic can be used, with needle assembly 13 slidably positioned therein. Needle assembly 13 comprises five hollow needles 14 for drying inner jacket compartments 15 of jacket 17 which may contain strips of microfilm (not shown) in FIG. 1. While five needles are shown passing through needle guide 21 in the preferred embodiment more or less needles may be used as desired. In operation, on/off valve 25 on foot control base 24 which is on the floor below table 11 is depressed by the operator's foot allowing a fluid such as pressurized air to flow from a tank (not shown in FIG. 1) or the like through control valve 26 and through fluid hose 27 to manifold 28 of needle assembly 13. Manifold 28 allows fluid to pass into inlets 31 at proximal ends 30 of hollow needles 14.

In order to dry the outer surfaces of microfilm jacket 17 seen in FIG. 1, apertures 18 are positioned in floor 19 of frame 12 to allow fluid flow from beneath, against the bottom outer surface of jacket 17 as positioned.

Further shown in FIG. 1, a fluid heater such as conventional hair dryer 40 with on/off switch 41 is partially contained within closed fluid chamber 42. Warm air is directed from fluid heater 40 through fluid conduit 43 which passes the heated air through apertures 18 in frame floor 19. Simultaneously, heated air passes through external fluid conduit 44 and exits proximate jacket 17 as shown in FIG. 1 to thereby dry the upper outer surface of jacket 17.

Figure 2:
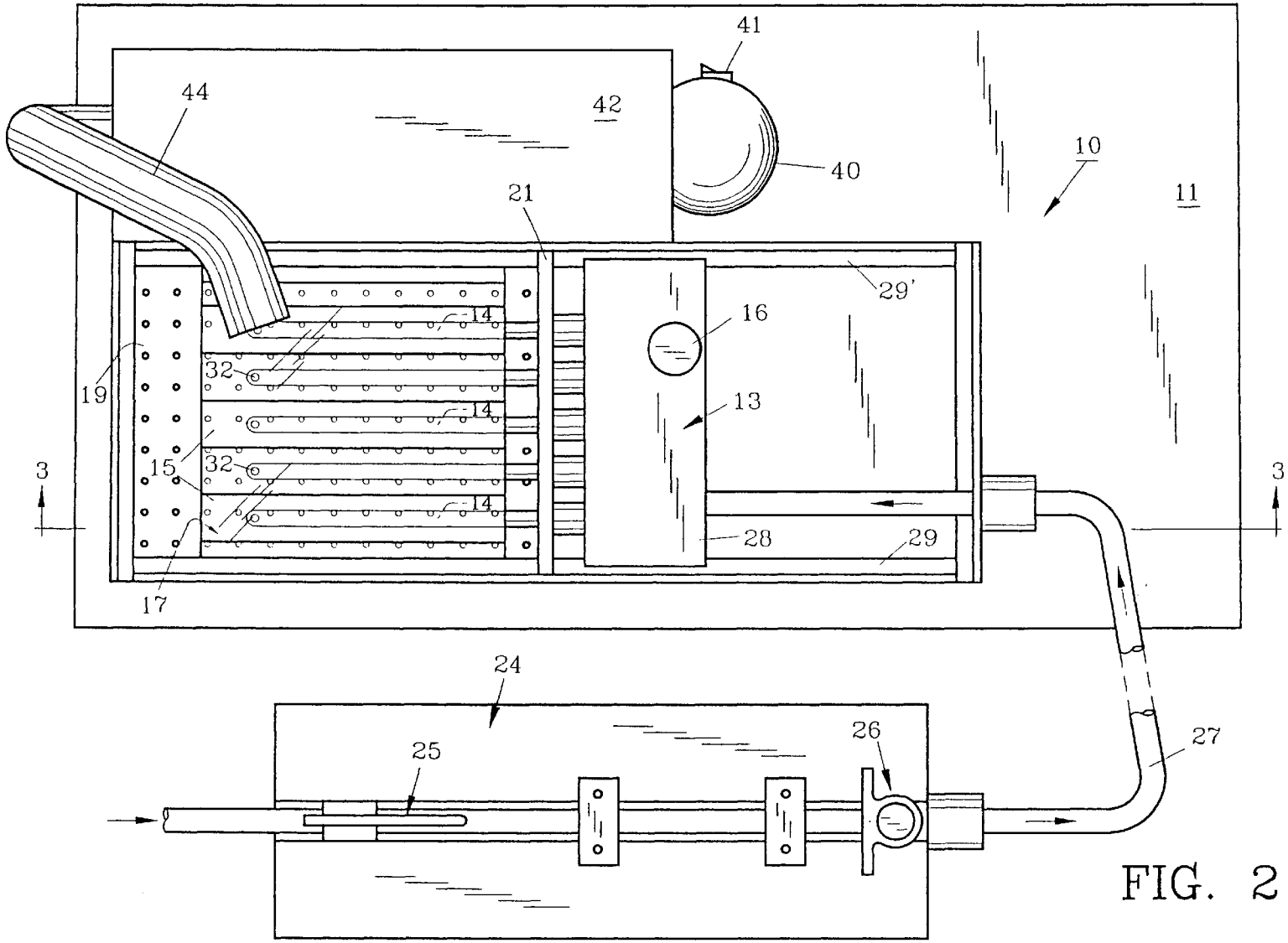
FIG. 2 illustrates the drying device as seen in FIG. 1 but with the needles fully inserted into the jacket compartments.

In order to slide needle assembly 13 from its dormant posture as shown in FIG. 1 into a drying position as seen in FIG. 2, knob 16 is manually grasped and slid from right to left along frame 12 as the edges of manifold 28 rest and slide on flanges 29, 29' as shown in FIGS. 1 and 2. In FIG. 2, needles 14 penetrate from one-half inch (1.27 cm) to the entire length of jacket compartments 15 by first separating the top and bottom walls of jacket 17 as further seen in FIG. 3. Microfilm strip 20 is seen below needle 14 within compartment 15.

Figure 7:
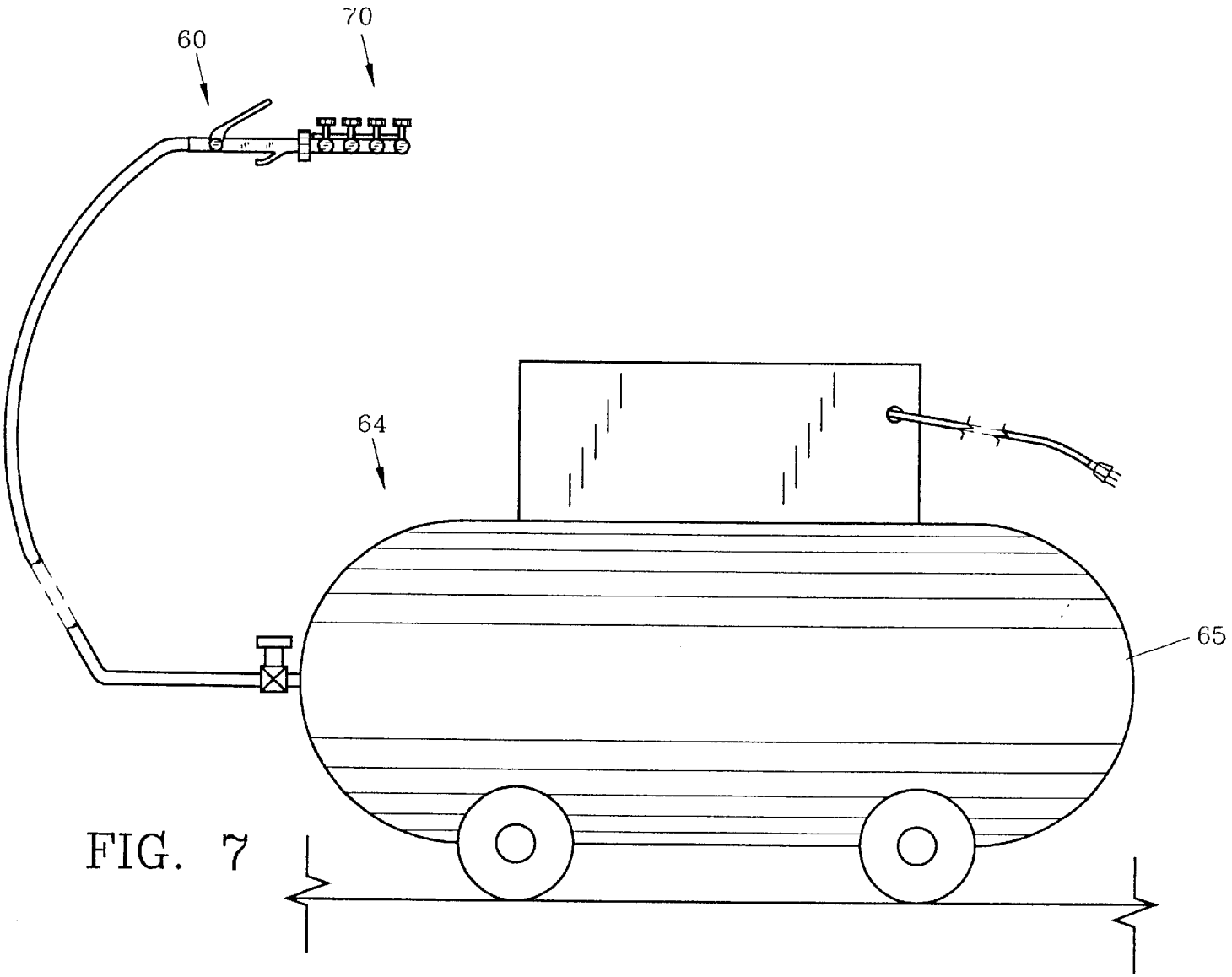
FIG. 7 illustrates a typical air compressor as connected to the hand held drying device seen in FIG. 6.

With control valve 26 open and on/off valve 25 depressed, fluid from a fluid source such as from air tank 65 shown in FIG. 7 passes through fluid hose 27 and into needles 14. The fluid then exits through distal end openings 32 of needles 14. Air exiting distal end openings 32 travels through and exits compartments 15 as shown in FIG. 2 of jacket 17. Once sufficient fluid has been delivered to jacket 17, for drying purposes, on/off valve 25 is released to terminate the fluid flow. Knob 16 is used to extract needles 14 from within jacket 17 and another wet jacket 17 is then placed on perforated floor 19 and the drying cycle is repeated.

Figure 3:
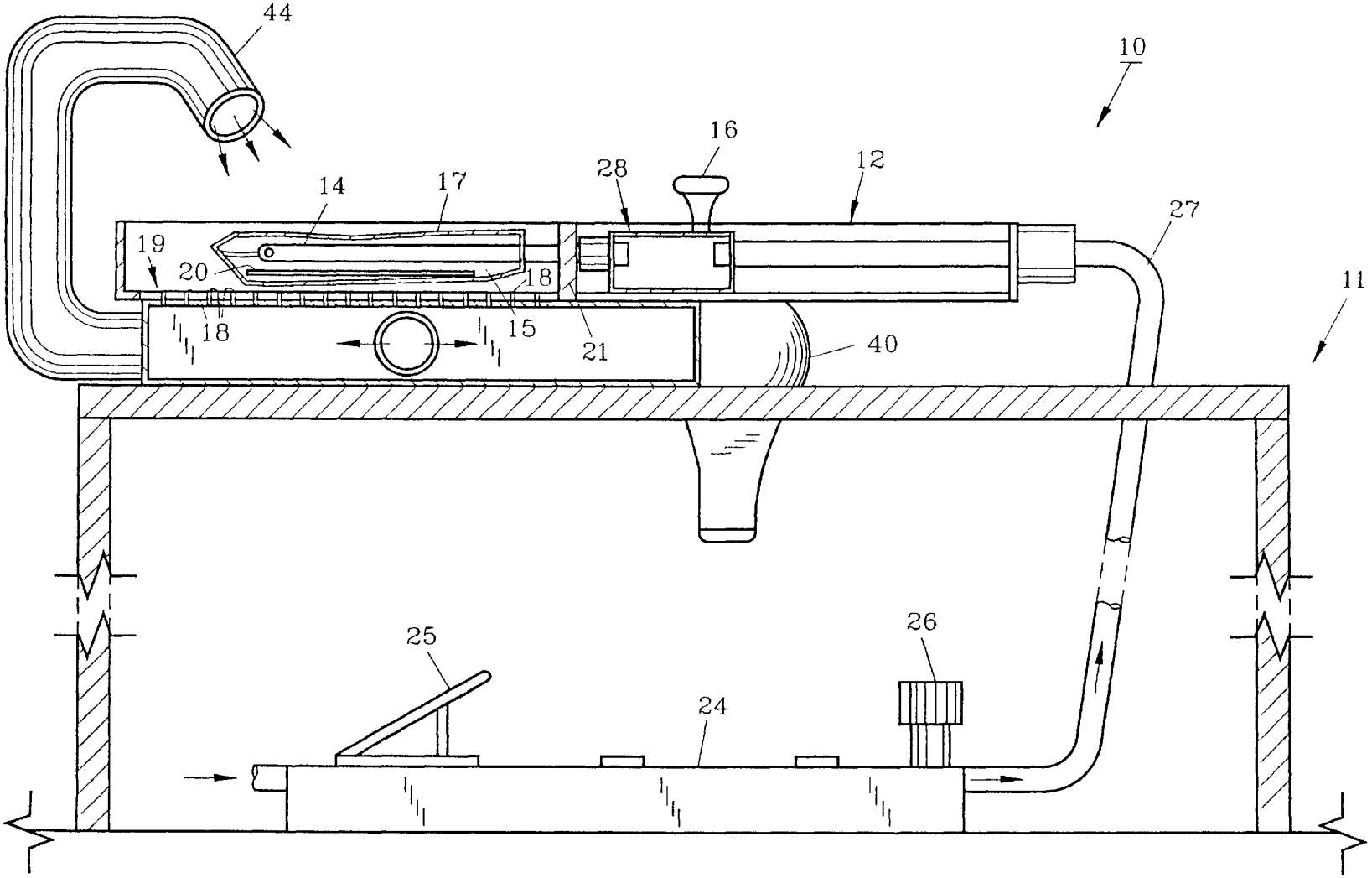
FIG. 3 shows a cross sectional view of the device of FIG. 1 along lines 3—3.

In FIG. 3, shown in somewhat cross sectional depiction along line 3—3 of FIG. 2, external fluid conduit 44 is shown delivering a heated fluid such as air onto jacket 17 while needles 14 have penetrated jacket 17 and simultaneously deliver air therein to interior compartments 15 of jacket 17 and its contents, such as microfilm strip 20.

Figure 4:
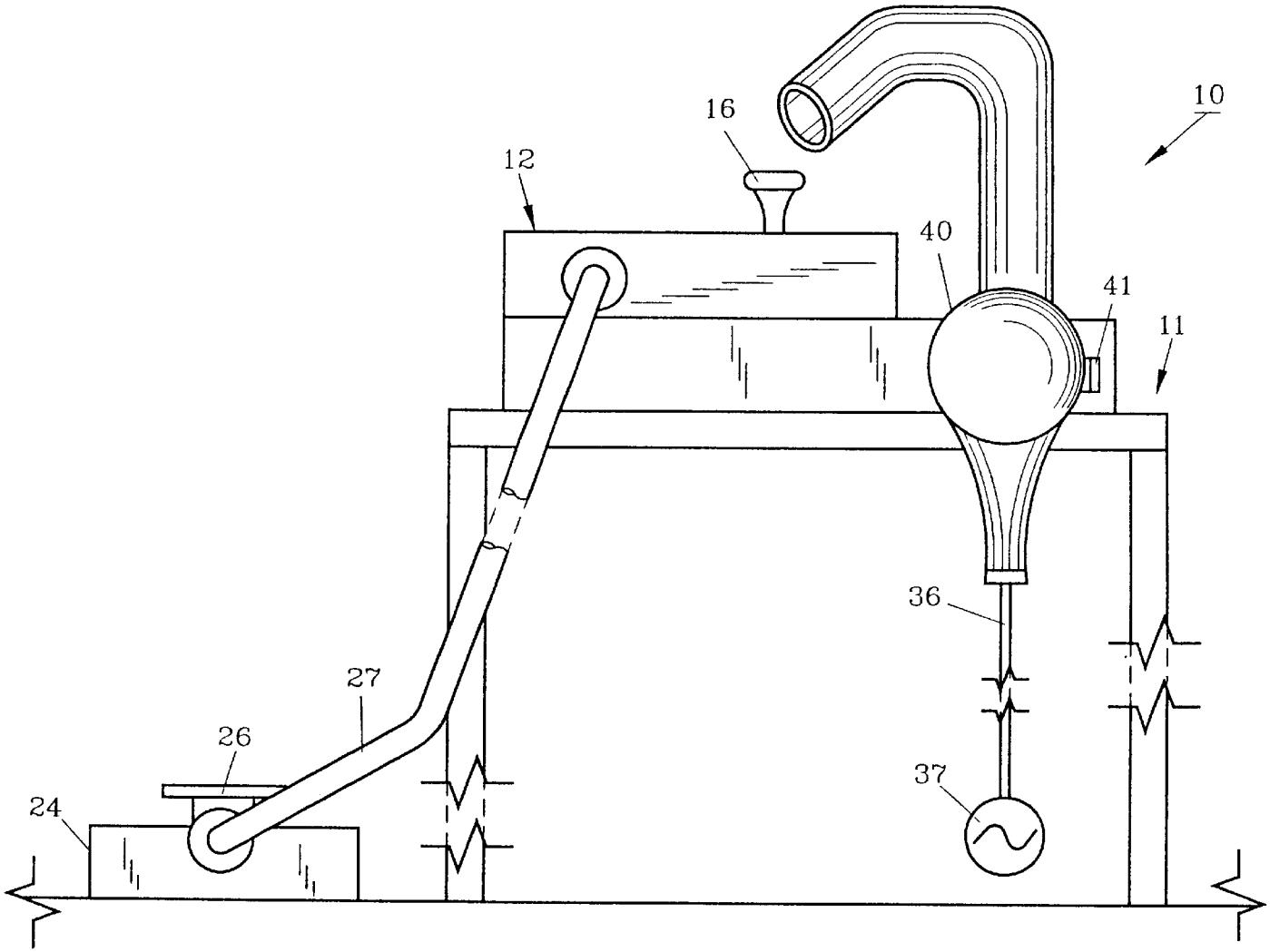
FIG. 4 depicts a right end elevational view of the drying devices seen in FIG. 1.

FIG. 4 shows a right side view of drying device 10 as seen in FIG. 1. Electrical cord 36 provides power to fluid heater 40 from a 110 volt AC source 37 such as a conventional wall outlet or the like, seen schematically in FIG. 4.

Figure 5:
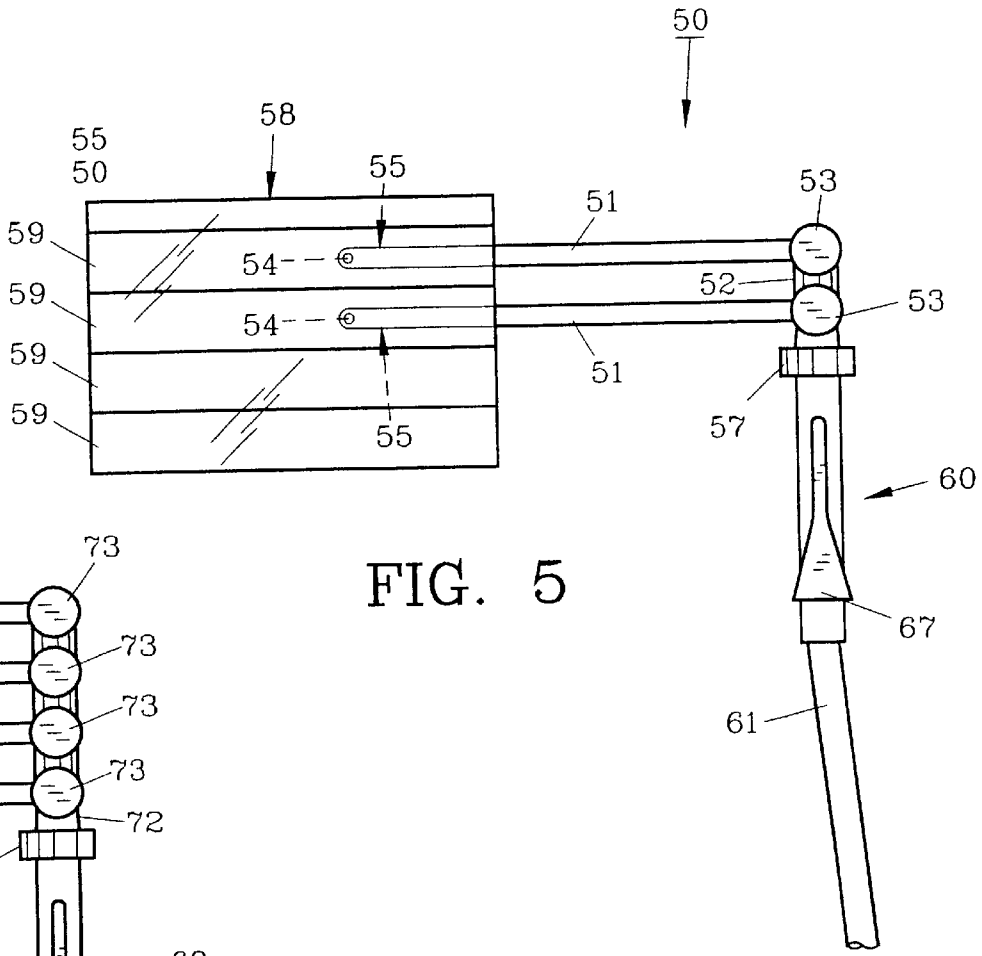
FIG. 5 features a top view of the hand held drying device of the invention having a pair of hollow needles.

In FIG. 5, a second embodiment of the invention is disclosed illustrating hand held drying device 50 having a pair of hollow needles 51. Needles 51 are joined to manifold 52 having control valves 53 for controlling the flow of air into needles 51. Needles 51 are positioned partially within two chambers 59 of jacket 58 for fluid delivery through outlets 54. Needles 51 may have from one to three outlets 54 in each distal end 55 thereof. Fitting 57 acts as a connector to allow standard air gun 60 to communicate with manifold 52. In use, by manually depressing trigger 67 of air gun 60, air from a suitable source such as tank 65 shown in FIG. 6 allows air to flow through gun 60 into manifold 53 where it is then directed through needles 51 into microfilm jacket 58 for drying two compartments 59 simultaneously. After the first two compartments 59 have been dried, drying device 50 can be removed and needles 51 inserted into the two next lower compartments 59 and the drying process is resumed.

Figure 6:
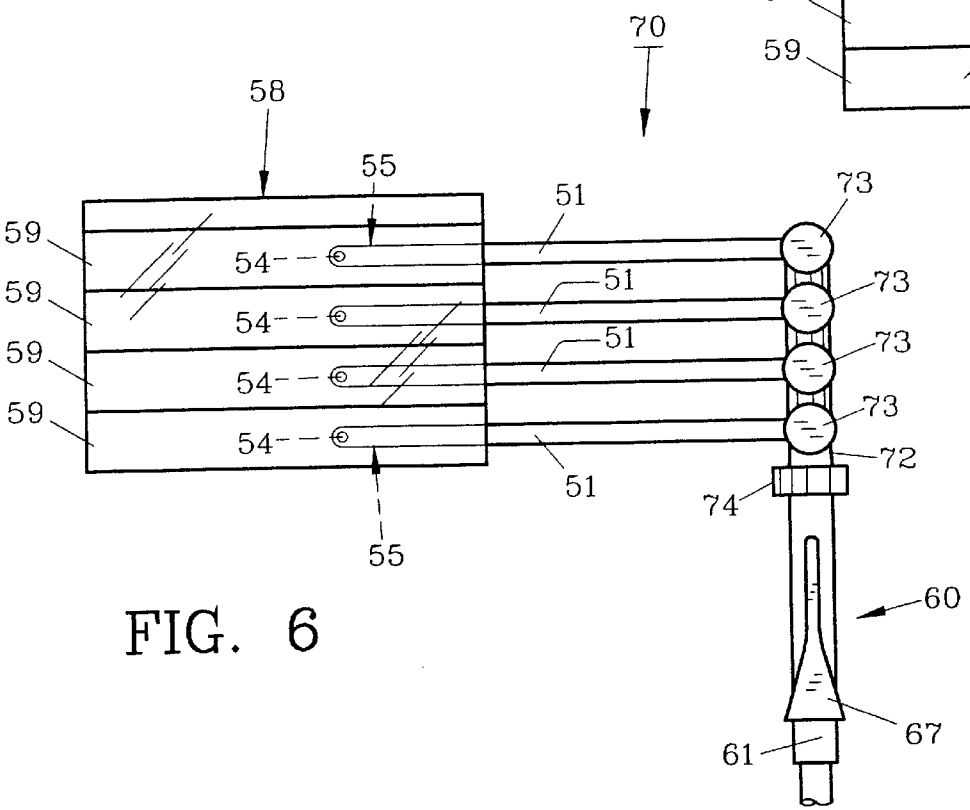
FIG. 6 shows a top view of another embodiment of the hand held drying device having four needles.

In FIG. 6 another embodiment of the invention is shown whereby hand held drying device 70 is seen in a top plan view. Drying device 70 is similar to drying device 50 and includes one to five needles 51 attached to manifold 72 (four needles 51 as illustrated in FIG. 6). Manifold 72 is joined by connector 74, again to standard air gun 60. Drying device 70 includes one to five control valves 73 atop manifold 72, one for each needle 51. Conventional air gun 60 is attached to pneumatic hose 61 which in turn is connected to an air source such as tank 65 of standard air compressor 64, seen in FIG. 7.

Various other fluids such as gases other than air could be used under special circumstances and the illustrations and examples provided herein are for explanatory purposes and are not intended to limit the scope of the appended claims.

We claim:

1. A device to dry a jacket for containing microfilm strips comprising: a hollow needle, said needle having proximal and distal ends, said needle defining an outlet in said distal end and an air inlet in said proximal end, a manifold, said needle communicating with said manifold, a control valve, said control valve positioned proximate said manifold to adjust fluid flow, into said jacket and a fluid source, said fluid source connected to said manifold.

2. The device of claim 1 comprising a plurality of hollow needles, each of said plurality of needles communicating with said manifold.

3. The device of claim 2 where said plurality of needles comprises two needles.

4. The device of claim 1 wherein said fluid source comprises an air tank.

5. The device of claim 1 wherein said needle is formed from stainless steel.

6. The device of claim 1 further comprising an air gun, said air gun connected to said manifold and to said fluid source.

7. A device configured to dry a jacket for containing microfilm strips, said device comprising: a manifold, a plurality of hollow needles, each of said needles communicating with said manifold, each of said needles defining an outlet, a fluid source, said fluid source connected to said manifold whereby fluid from said fluid source can flow through said manifold and into each of said plurality of needles and exit said needles through said outlets and into said jacket.

8. The device of claim 7 further comprising a control valve, said control valve communicating with said manifold to control the fluid flow therethrough.

9. The device of claim 7 further comprising an on/off valve, said on/off valve communicating with said manifold and said fluid source to selectively allow fluid to pass to said manifold.

10. The device of claim 7 wherein said fluid source comprises an air tank.

11. The device of claim 10 further comprising an air compressor, said air tank connected to said air compressor.

12. A device for drying microfilm strips in a jacket comprising: a frame, a needle assembly, said needle assembly moveably positioned on said frame, said needle assembly in fluid communication with a fluid source whereby fluid from said fluid source is delivered through said needle assembly into said jacket to dry said microfilm stines.

13. The device of claim 12 wherein said needle assembly comprises a hollow needle, a manifold, said hollow needle communicating with said manifold.

14. The device of claim 12 further comprising a needle guide, said needle guide affixed to said frame.

15. The device of claim 12 wherein said frame comprises a perforated bed, a fluid chamber, said fluid chamber in communication with said perforated bed.

16. The device of claim 15 further comprising an external fluid conduit, said external fluid conduit communicating with said fluid chamber.

17. The device of claim 15 further comprising a fluid heater, said fluid heater communicating with said fluid chamber.

18. A method of drying microfilm contained within a jacket comprising the steps of:

a) opening the jacket;

b) placing a hollow needle in the jacket; and c) directing a fluid through the needle into the jacket to dry the microfilm.

19. The method of claim 18 wherein opening the jacket comprises the steps of separating the walls of the jacket with the hollow needle.

20. The device of claim 18 wherein directing a fluid comprises the steps of forcing air through the needle into the jacket to contact the microfilm.

* * * * *